United States Patent [19]

Soler et al.

[11] Patent Number: 4,916,995

[45] Date of Patent: Apr. 17, 1990

[54] ELECTRICAL GUITAR

[76] Inventors: Alejandro S. Soler, No. 22 Coconut Street, Valle Verdi IV Pasig, Metro Manila, Philippines; Gerardo V. Boromeo, N. Escario Street, Cebu City, Metro Manila, Philippines

[21] Appl. No.: 300,358

[22] Filed: Jan. 23, 1989

[51] Int. Cl.[4] ..... G10D 3/02

[52] U.S. Cl. ..... 84/291; 84/268

[58] Field of Search ..... 84/265, 268, 269, 275, 84/284, 285, 290, 291, 292

[56] References Cited

U.S. PATENT DOCUMENTS 567,028 9/1896 Hall ..... 84/268
989,510 4/1911 McCullough ..... 84/268
3,440,919 4/1969 Baker ..... 84/291
3,769,871 11/1973 Cawthorn ..... 84/291

*Primary Examiner*—Lawrence R. Franklin
*Attorney, Agent, or Firm*—Knobbe, Martens, Olson & Bear

[57] ABSTRACT

An improved musical instrument, having a veneer comprising seashells in a fiberglass and polyester resin. A method for producing a seashell veneer, which includes preparing a selected surface with a polyester and fiberglass based resin; heating seashells to deformation and affixing the seashells to the surface; striking the heated shells to create a plurality of smaller elements; coating the affixed shell segments with the fiberglass and polyester resin to fill the interstitial spaces; sanding the surface to achieve a desired finish.

14 Claims, 1 Drawing Sheet

ELECTRICAL GUITAR

BACKGROUND OF THE INVENTION

This patent application claims priority from and incorporates by reference the disclosure of Philippine Pat. No. 119303, filed Jan. 21, 1988. This invention relates to a method for applying a seashell veneer to a selected surface. The method has particular applicability to musical instruments and specifically stringed musical instruments, such as guitars. More particularly, the present invention relates to an exterior veneer, comprising seashells and a polyester resin based adhesive, which provides for improved acoustical characteristics and durability of the instrument.

DESCRIPTION OF THE PRIOR ART

The physical structure of musical instruments is determinative of their acoustical value. Because the structure of the instrument may not be substantially modified without altering the acoustical characteristics of the instrument, musical instruments are especially susceptible to acoustical degradation through physical stresses. Attempts to provide musical instruments with some resistance to physical degradation have included the use of paints, shellacs, lacquers and waxes on the exterior of the instrument. However, these coverings do not provide the instrument with a sufficiently protective layer, so that upon any damage to the exterior coating results in structural damage to the instrument. Therefore, these coverings do not afford the instrument an increased resistance to physical stresses.

In addition, these exterior coatings often absorb the sound produced by the strings, thereby decreasing the acoustical capability of the instrument. Also, such coatings are susceptible to ambient temperature fluctuations, which cause the varying thermal expansion coefficients to distort the structure of the instrument and thereby lead to a deterioration in sound quality of the instrument.

SUMMARY OF THE INVENTION

Accordingly, the present invention provides a protective veneer for the exterior of a stringed instrument wherein the veneer provides for an improved acoustical performance of the instrument. In addition, the present invention provides a method for the application of a seashell veneer to a selected surface. Typical seashells which are compatible with the present invention include Oysters, Jewel Boxes, Jingle Shells, Mussels, Razor Clams, Pen Shells, Claims, Pandoras, Lockles, Arks, Angel Wings, Scallops, Abalones and Keyhole Limpets. However, other seashells may be employed in the present invention.

The present invention provides a seashell and polyester resin based veneer, which may be applied to selective parts or the entire exterior of an instrument. The seashell veneer provides a protective layer which will not warp during ambient temperature fluctuations. In addition, the seashell veneer provides the instrument with an acoustically non-porous surface which prevents sound absorption. The veneer reverberates, rather than absorbs sound waves emitted from the strings. For example, an electrical guitar employing the present invention exhibits an improved sustaining sound production.

The present invention includes a method of affixing seashells to a selected surface to form a veneer. The surface is prepared to provide a receptive bonding surface for a mixture of a polyester resin having an increased viscosity through the addition of raw fiberglass, an accelerator, and a hardener. Selected, cleaned and dried seashells, having a substantially planar configuration are then heated with a propane torch to a temperature at which deformation of the shells is initiated. The heated shell is then disposed on the mixture coated surface and struck with a soft mallet, to break the shell into smaller elements. These elements conform to the curvature of the selected surface. A second coating of the adhesive mixture may then be applied over the affixed shells to fill interstitial spaces between the shell fragments. After hardening, the surface is then sanded with a fine grit paper until the desired finish is achieved. A coloring may be added to the adhesive mixture to provide the veneer with a desired tint to interact with the colors of the selected shells.

DETAILED DESCRIPTION OF THE PREFERRED EMBODIMENT

Figure 1:
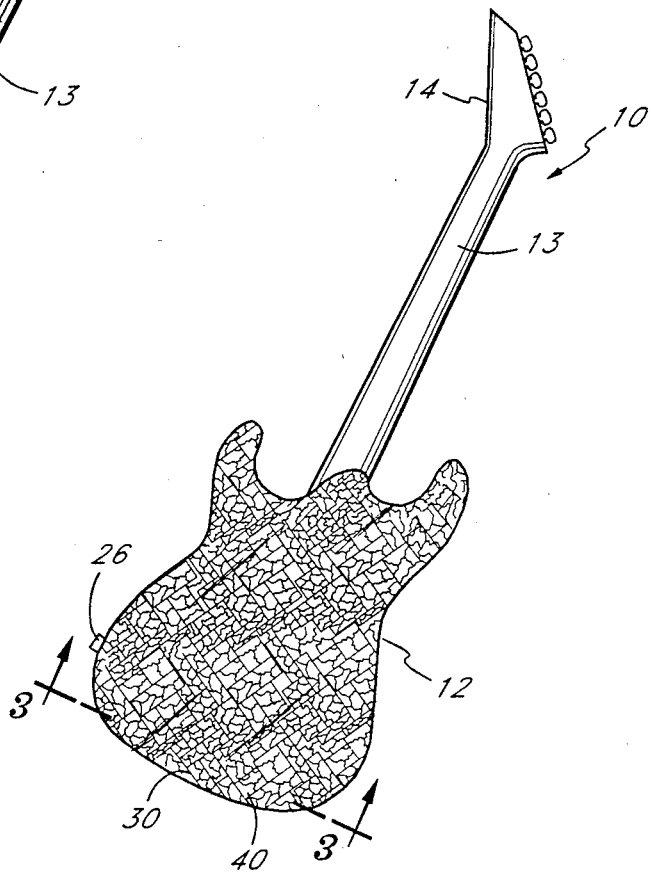
FIG. 1 is a perspective of an electrical guitar including the present invention.

Referring to FIG. 1, an improved electrical guitar 10 having an external surface comprising of randomly disposed seashell segments 30 is shown. The shell segments 30 may be arranged in any desired pattern. These patterns may include reproducible patterns or entire scenes. Alternatively, as shown in FIG. 1, the selected pattern may be a random configuration. Although the design shown in FIG. 1 represents a random configuration, it will be apparent to one skilled in the art that the shells may be arranged in any desired predetermined pattern.

As shown in FIG. 1, the veneer 50 represents a plurality of shell segments 30 disposed on the exterior of the guitar 10. Each shell segment 30 contains a plurality of irregularly configured elements 40. The shell segments 30 are bonded to the guitar 10 by a glue mixture 60. The components of the mixture include a polyester resin, which acts as a basic adhesive material; raw fiberglass strips, which act as a reducer to the polyester resin, thereby producing a desired viscosity level; a cobalt accelerator, which serves as a promoter or accelerator of the jelling of the polyester resin and the fiberglass; and a hardener which hardens the mixture of the polyester resin, fiberglass and the accelerator. These components are commercially available from Pioneer Paint.

The seashells 28 may be obtained from beaches or retrieved from the sea floor. The shells 28 may be of any color or appearance that is deemed desirable. After the shells 28 have been brought to the surface, they are thoroughly dried. The shells 28 are then scrubbed with a wire brush to remove any barnacles and other sea contaminants. After being brushed, the shells 28 may be selected for their clarity and color. The selected shells 28 are then cut to obtain a substantially planar shell segment 30. The shells 28 may be cut by a hard steel rotary saw or other suitable means. Having been dried, cleaned and cut, the shell segments 30 are then ready for application to the selected surface.

Figure 2:
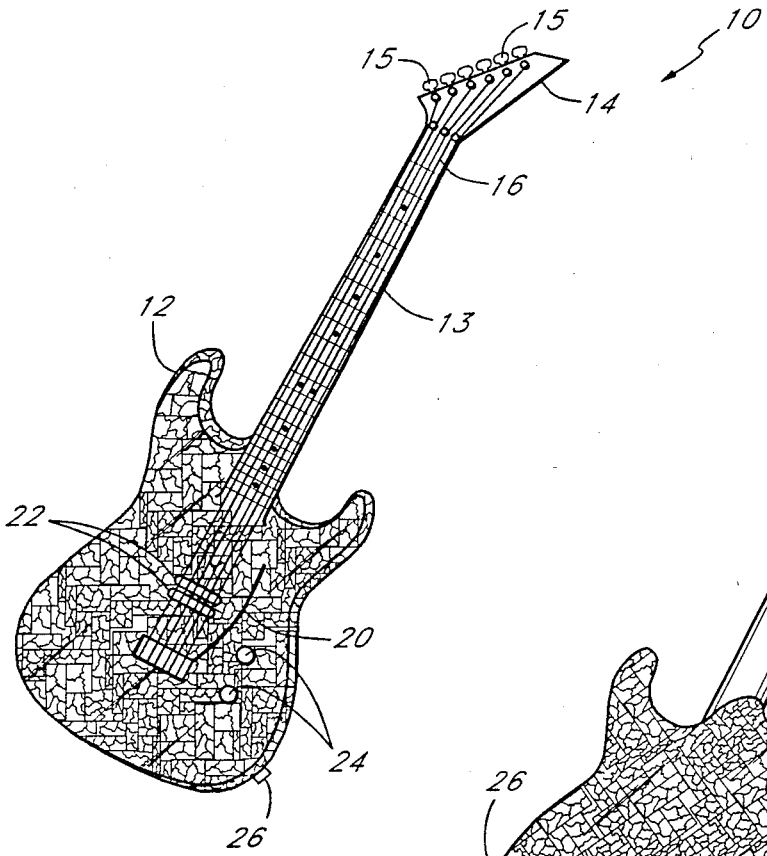
FIG. 2 is a perspective of an electrical guitar.

Referring to FIG. 1, the shell segments 30 may be disposed on the exterior surface of a guitar 10. The guitar 10 includes a body 12, a neck 13 extending from the body 10 and a head 14 at the distal end of the neck 13. The head 14 includes pegs 15 which attach to the strings 16, for maintaining the desired string tension. The neck 13 includes a fret board 17 which provides the user with a surface against which the strings are held to alter their effective length. As shown in FIG. 2, the guitar includes a bridge 18 which secures the strings 16 to the body 12, a tremolo bar 20 for varying the length of the strings, and pick-ups 22 for sensing the sound waves generated by the strings 16. Additional hardware such as controls 24 and connectors 25 to a sound system may also be provided. In the embodiment of a guitar 10 having the disclosed veneer 50, the body 12 may have both the front and the back covered with the veneer 50. However, the neck 13, head 14 and fret board 17 may also have the veneered surface. Prior to the application of the veneer 50, the strings 16, bridge 18, tremolo bar 20, pick-ups 22, controls 24 and connectors 26 are removed from the guitar 10.

Figure 3:
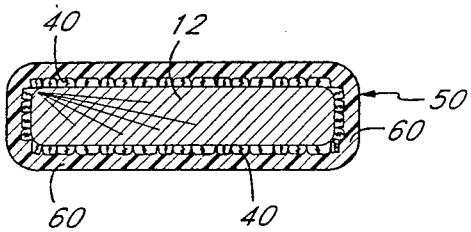
FIG. 3 is a cross-sectional view taken along lines 3—3 of FIG. 1.

In order to obtain efficient gluing, the wooden surface of the guitar which is to be veneered is sanded until the wood surface exhibits smooth texture. After sanding, the wood surface is cleaned of any grease, oil and remaining wood particulate matter. After preparation of the wood surface of the guitar 10, the polyester resin is mixed with the raw fiberglass to obtain a mixture having a viscosity such that, upon addition of the accelerator and hardener, the mixture 60 may be applied to the wood surface without pooling or dripping. A selected seashell segment 30 is then heated to approximately 105° F. with a propane torch or any other means well known in the art to the point of deformation. The seashell segment 30 is then disposed on the guitar surface in a selected orientation, whereupon the shell segment 30 is struck with soft mallet. Referring to FIG. 3, striking of the shell segment 30 with the mallet breaks or fragments the segment 30 into a plurality of irregularly configured elements 40. The size of the elements 40 is determined by the number of times the shell segment 30 is struck. That is, a greater number of elements is produced through a repeated striking of the shell segment 30 with the mallet. The rendering of the shell segment 30 into a plurality of smaller elements 40 allows the veneer 50 to substantially conform to the curvature of the guitar 10. Upon creating sufficiently small elements 40 so that the shell segments 30 conform to the shape of the guitar 10, the elements 40 may be left at that size, or if smaller elements 40 are desired, the shell segments 30 may be repeatedly struck until the desired appearance is obtained. This process of applying adhesive and affixing heated shells and fracturing the shells is repeated until the desired section of the instrument is covered with shell segments 30.

Referring to FIG. 3, after the desired portion of the selected surface has been veneered, the surface has a rough texture, resulting from the interstitial spaces between the shell elements 40 and the varying thickness of the shell segments 30. The adhesive mixture 60 is then reapplied to the surface to fill the interstitial spaces. This mixture 60 may also include a coloring to provide the veneer which has a predetermined tint. Any excess mixture is immediately removed with a soft cloth. After the mixture 60 has hardened, the veneer 50 is sanded, or buffed, with a fine sand paper to produce a uniform surface. The surface is then substantially comprised of polished seashells, with hardened mixture 60 filling the interstitial spaces.

The veneer 50 may be left in this state or, alternatively, a lacquer or shellac may be applied over the seashell veneer 50.

Although the present invention has been described in terms of particular embodiments, it is not limited to these embodiments. Alternative embodiments and modifications which would still be encompassed by the invention, may be made by those skilled in the art, particularly in light of the foregoing teachings. Alternative embodiments, modifications or equivalents may be included within the spirit and scope of the invention as defined by the claims.

We claim:

1. An improved guitar, wherein said improvement comprises:
   a plurality of seashell segments affixed to the body of said guitar to form an exterior surface on said guitar for improving the sustained acoustical responses of said guitar.

2. The guitar of claim 1, wherein each of said segments includes a plurality of elements.

3. The guitar of claim 1, wherein said shell segments are randomly affixed to said guitar.

4. The guitar of claim 1, wherein said shell segments are glued to said guitar.

5. The guitar of claim 4, wherein said shells are glued to said guitar in a random pattern.

6. The glue of claim 4, wherein said glue comprises:
   a polyester resin;
   raw fiberglass;
   an accelerator; and
   a hardener.

7. The glue of claim 6, wherein said accelerator comprises:
   cobalt.

8. An improved stringed instrument, wherein said improvement comprises:
   a plurality of seashell segments affixed to the body of said stringed instrument to form an exterior surface on said stringed instrument for improving the sustained acoustical responses of said stringed instrument.

9. The stringed instrument of claim 8, wherein each of said segments includes a plurality of elements.

10. The stringed instrument of claim 8, wherein said shell segments are randomly affixed to said stringed instrument.

11. The stringed instrument of claim 8, wherein said shell segments are glued to said stringed instrument.

12. The stringed instrument of claim 11, wherein said shell segments are glued to said stringed instrument in a random pattern.

13. The glue of claim 11, wherein said glue comprises:
   a polyester resin;
   raw fiberglass;
   an accelerator; and
   a hardener.

14. The glue of claim 13, wherein said accelerator comprises:
   cobalt.

* * * * *